US007806040B2

(12) United States Patent
Peterson

(10) Patent No.: US 7,806,040 B2
(45) Date of Patent: Oct. 5, 2010

(54) BALL SUPPORTED SWASHPLATE FOR AXIAL PISTON HYDRAULIC MACHINE

(75) Inventor: Mark A. Peterson, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 398 days.

(21) Appl. No.: 11/854,020

(22) Filed: Sep. 12, 2007

(65) Prior Publication Data

US 2009/0064856 A1 Mar. 12, 2009

(51) Int. Cl.
*F01B 3/02* (2006.01)

(52) U.S. Cl. ..... 92/12.2

(58) Field of Classification Search ..... 92/12.2; 91/505, 506

See application file for complete search history.

(56) References Cited

U.S. PATENT DOCUMENTS

| | | | | | |
|---|---|---|---|---|---|
| 3,698,189 | A | * | 10/1972 | Reimer | 60/489 |
| 4,703,682 | A | * | 11/1987 | Hansen | 92/12.2 |
| 4,916,901 | A | | 4/1990 | Hayashi et al. | |
| 5,826,488 | A | * | 10/1998 | Arai et al. | 92/12.2 |
| 5,928,099 | A | | 7/1999 | Tsunemi | |
| 6,524,206 | B2 | | 2/2003 | Tsunemi et al. | |
| 6,688,417 | B2 | | 2/2004 | Hansell | |
| 7,021,904 | B2 | * | 4/2006 | Shimizu | 92/12.2 |
| 7,076,948 | B2 | | 7/2006 | Ito et al. | |
| 7,152,403 | B2 | | 12/2006 | Yoshida | |
| 2004/0206079 | A1 | | 10/2004 | Ito et al. | |

FOREIGN PATENT DOCUMENTS

| | | |
|---|---|---|
| DE | 19620654 | 11/1997 |
| JP | 59079078 | 5/1984 |
| JP | 59113274 | 6/1984 |
| JP | 9088809 | 3/1997 |
| JP | 10054344 | 2/1998 |
| JP | 2000179450 | 6/2000 |
| JP | 2001254685 | 9/2001 |
| JP | 2003120517 | 4/2003 |

* cited by examiner

*Primary Examiner*—F. Daniel Lopez

(57) ABSTRACT

An axial piston hydraulic machine having a housing with a cylinder block with reciprocating pistons disposed therein. The reciprocating pistons are rotatably connected to a swashplate at a first end of the swashplate. At a second end of a swashplate support balls are received and engage the housing. The support balls are located radially from the plurality of reciprocating pistons such that the distance between the axis of rotation of an input shaft and a piston axis of the plurality of pistons is significantly less than the radial distance between the axis of rotation of the shaft and the center points of the support balls, and wherein the pivot axis passing through the center points of the support balls lies in or near the plane passing through the piston/slipper ball joints.

4 Claims, 3 Drawing Sheets

BALL SUPPORTED SWASHPLATE FOR AXIAL PISTON HYDRAULIC MACHINE

BACKGROUND OF THE INVENTION

This invention relates to axial piston hydraulic machines. More specifically, this invention relates to an axial piston hydraulic machine having a ball supported swashplate.

Many existing motor/gearbox combinations for track drives on construction equipment utilize an axial piston hydraulic machine having a swashplate which pivots on two balls located in ball sockets in the back of the swashplate and in the supporting housing. These designs place the support balls directly behind the piston running surface of the swashplate. Consequently, the swashplate pivot axis, is a significant distance behind the plane passing through the centers of the piston/slipper ball joints. When the pivot axis of the swashplate is not near the plane passing through the centers of the piston/slipper ball joints, the moments on the swashplate can vary significantly, making it difficult to control the position of the swashplate. Specifically, in intermediate positions there is a wide variation in swashplate moments due to varying pressure and speeds. Similarly, the variation between pumping and motoring modes causes significant swashplate moments.

Therefore, a principal object of the present invention is to provide an axial piston pump that allows for enhanced control of the swashplate.

Yet another object of the present invention is to minimize the variability of the moments on the swashplate.

Another object of the present invention is to reduce the axial length of a motor or a gearbox package.

These and other objects, features, or advantages of the present invention will become apparent from the specification and claims.

BRIEF SUMMARY OF THE INVENTION

An axial piston hydraulic machine that has a housing that encloses a cylinder block having a plurality of reciprocating pistons disposed therein. The hydraulic machine additionally has a swashplate that is rotatably connected to the plurality of reciprocating pistons and a shaft is disposed through the swashplate and cylinder block within the housing to rotate the cylinder block about an axis of rotation of the shaft. First and second support balls are located radially from the reciprocating pistons and are received by the swashplate and housing.

Specifically, each support ball has a center point wherein a pivot axis running through the center points of the first and second support balls is located in the plane of piston/slipper ball joints.

DETAILED DESCRIPTION OF THE PREFERRED EMBODIMENT

Figure 1:
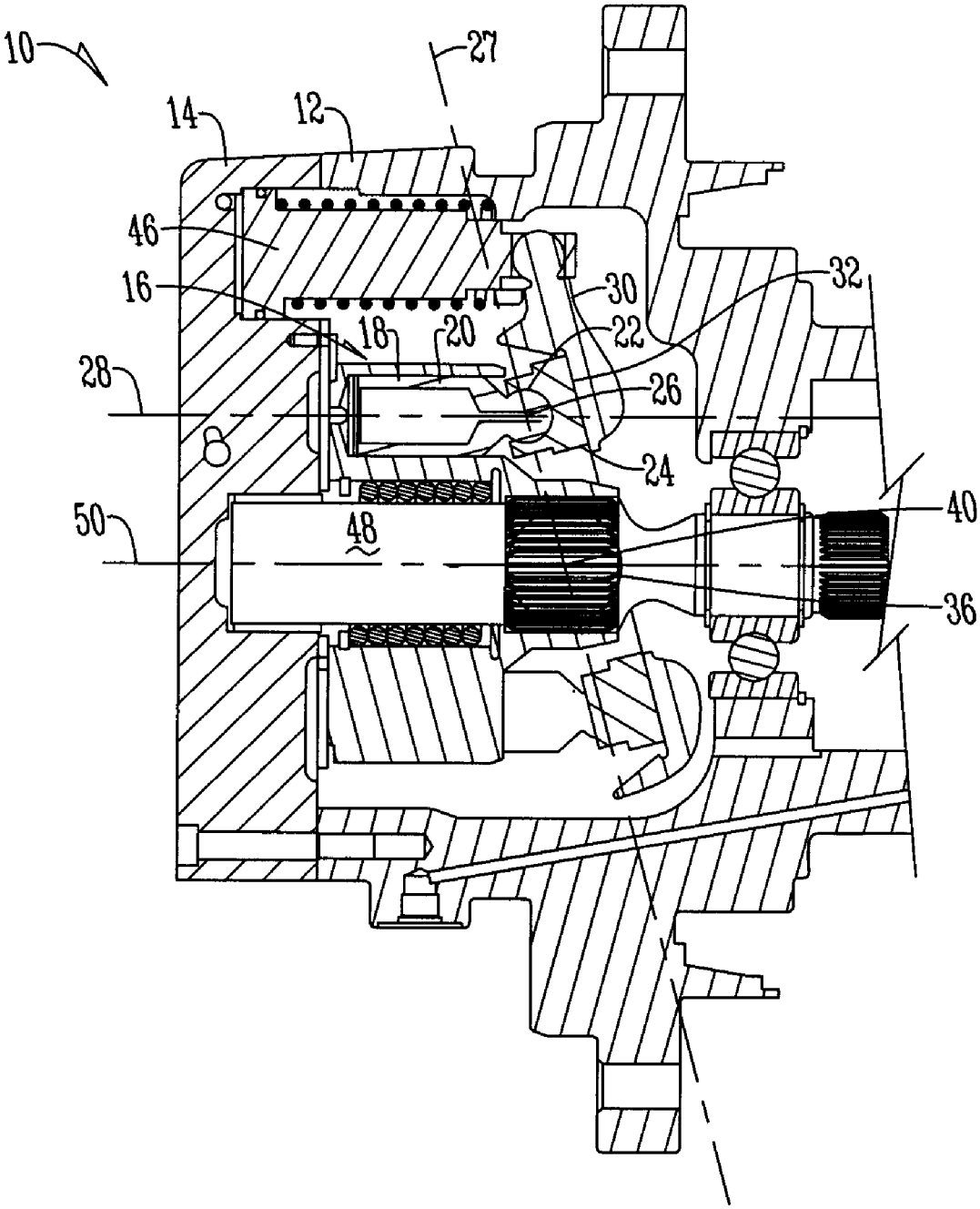
FIG. 1 is a sectional side view of an axial piston hydraulic machine having a swashplate at a maximum angle.

The figures show an axial piston hydraulic machine 10 having a housing 12 that is secured to an end cap 14. Though shown in two-piece construction comprising a housing 12 and an end cap 14 the axial hydraulic machine 10 in another embodiment could be of one-piece construction.

A cylinder block 16 is disposed within the housing 12. The cylinder block 16 has a plurality of reciprocating pistons 18 disposed therein. The plurality of reciprocating pistons 18 have bodies 20 that can comprise a hollow cavity. The piston bodies 20 in the embodiment shown in the Figures have male ball joints 22 that are rotatably connected to female slippers 24. While shown as male ball joints 22 with female slippers 24, the connection could consist of a piston body 20 with a female end that receives the male end of a slipper 24. Regardless, each slipper/ball joint connection has a piston connection center point 26 wherein the plane that runs through those center points is joint plane 27. Additionally, each of the plurality of pistons 18 has a piston axis 28 that runs axially along the center of each piston.

A swashplate 30 engages the plurality of slippers 24 at a first end 32 and extends to a second end 34. The second end 34 receives first and second support balls 36, 38 that both engage the housing 12. Each support ball 36, 38 contain a center point 40, 42 wherein a support ball pivot axis 44 runs through the first and second center points 40, 42. The swashplate 24 is also connected to an auxiliary piston 46 for reciprocation within the end cap 14.

A shaft 48 is disposed within the housing 12 through the swashplate 30 and cylinder block 16 into the end cap 14. The shaft 48 rotates along an axis of rotation 50 to rotate the cylinder block 16. One skilled in the art will appreciate that the point where the joint plane 27 intersects the axis of rotation 50 of the shaft 48 is considered the sweet spot of the axial piston rotating group. When the sweet spot of the axial piston rotating group and the pivot axis of swashplate are not located in the same plane the moments acting on the swashplate experience undesirable variability as the tilt position of the swashplate is changed.

Figure 2:
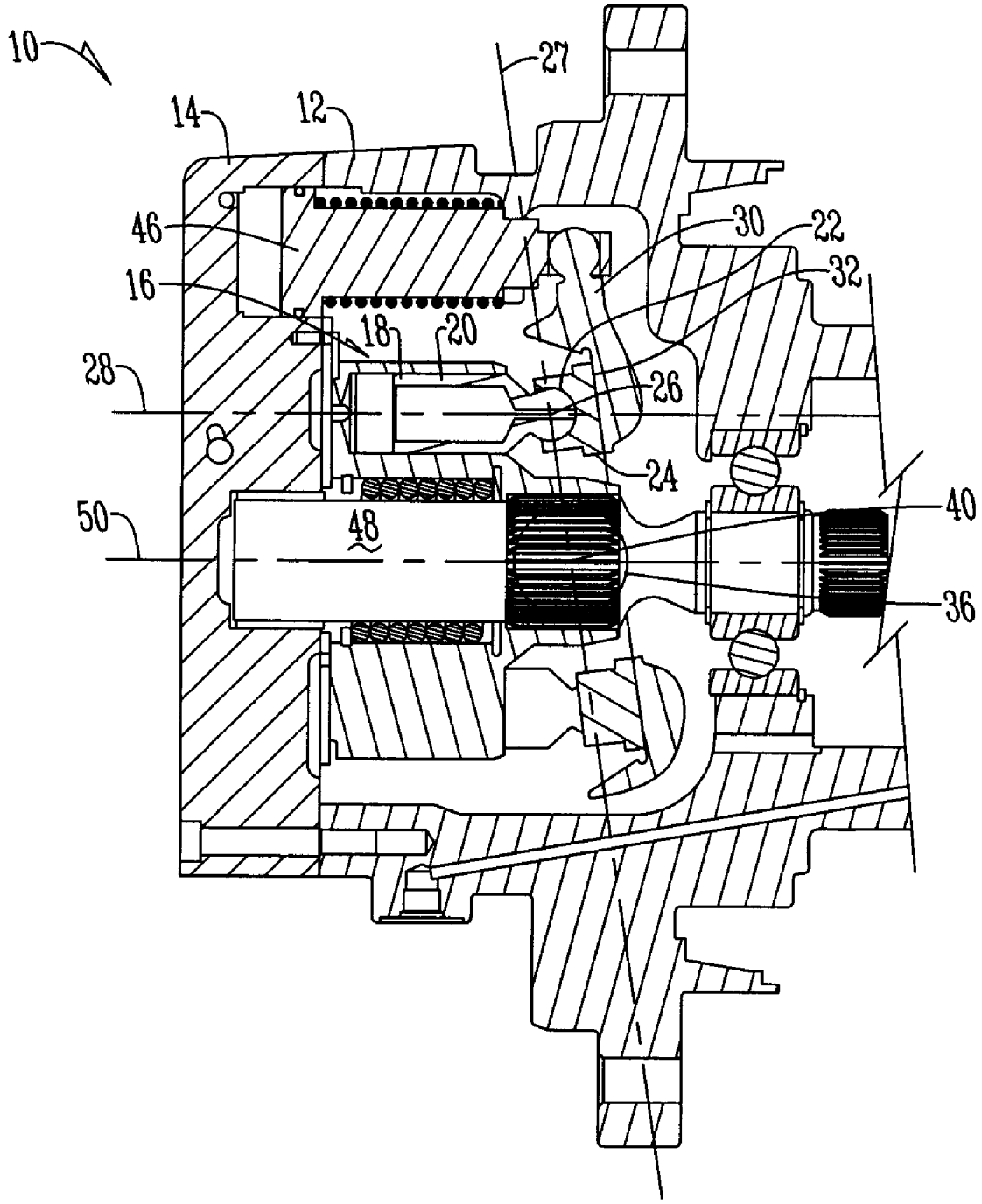
FIG. 2 is a sectional side view of an axial piston hydraulic machine having a swashplate at a minimum angle.
Figure 3:
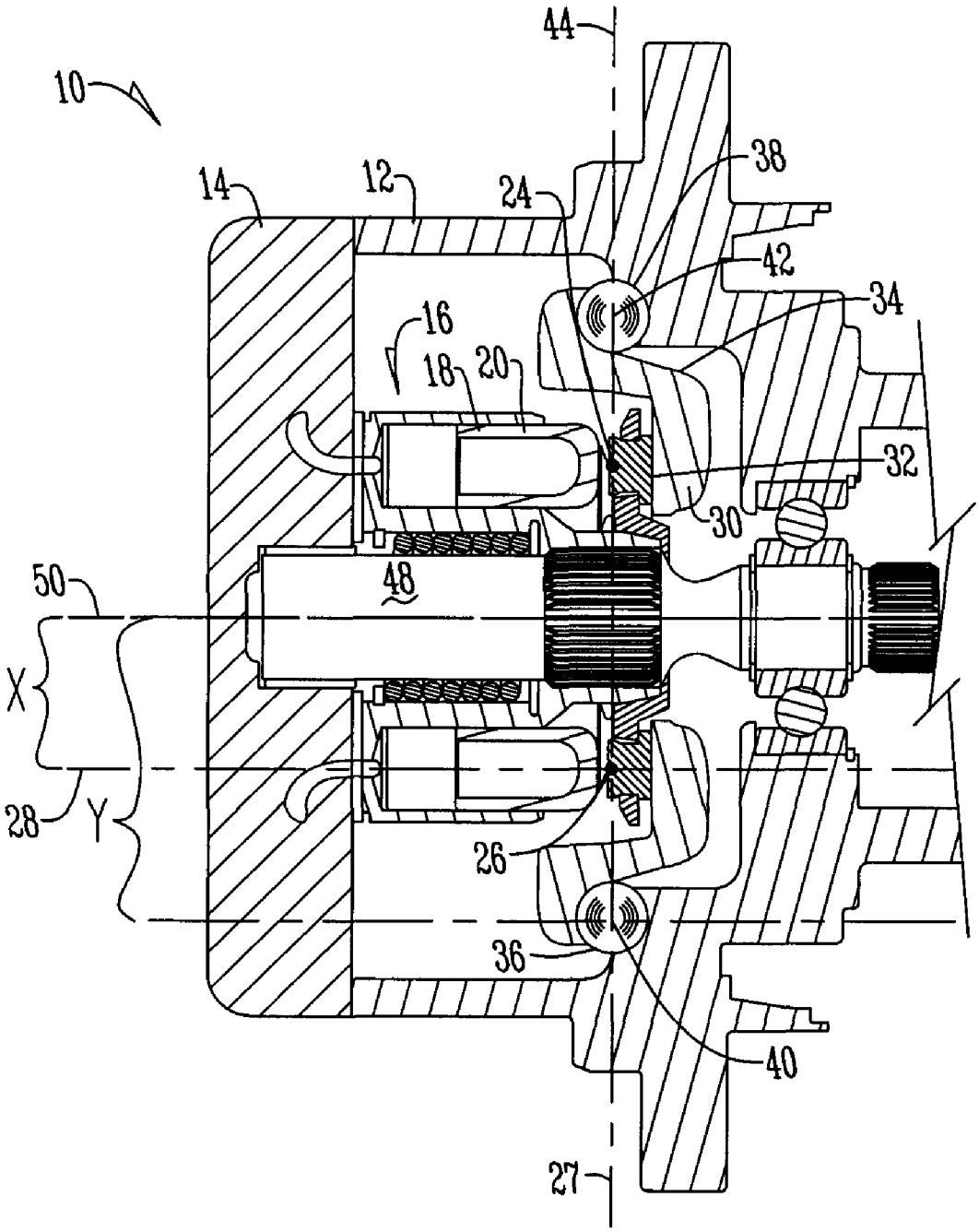
FIG. 3 is a section top view of an axial piston hydraulic machine.

In the axial piston hydraulic machine of FIGS. 1-3 the first and second support balls 36 and 38 are positioned relative to the cylinder block 16 such that the joint plane 27 and ball pivot axis 44 are in the same plane, thus minimizing the variability of the swashplate moments. Alternatively, the axial piston hydraulic machine can be designed such that the joint plane 27 and ball pivot axis 44 are in close proximity to reduce the variability of the swashplate moments. For instance the ball pivot axis 44 can intersect the plurality of pistons including the slippers 24. Alternatively the ball pivot axis 44 could intersect the swashplate 30. In these embodiments the joint plane 27 and ball pivot axis 44 are not in the same plane but are kept in close proximity thereby reducing swashplate moment variability.

Additionally as a consequence of the wide positioning of the first and second support balls 36 and 38 the radial distance between the axis of rotation 50 of the shaft 48 and the support balls 36, 38 is significantly greater than the radial distance between the axis of rotation 50 of the shaft 48 and piston axis 28. Specifically, as shown in FIG. 3 the radial distance from the axis of rotation 50 of the shaft 48 and the piston axis 28 is first radial distance X. Similarly, the radial distance from each center point 40, 42 to the axis of rotation 50 of the shaft 48 is a second radial distance Y wherein the second radial distance Y is significantly greater than the first radial distance X.

Thus, the disclosed axial hydraulic machine 10 is specially designed such that the first and second support balls 36, 38 are radially adjacent or near the piston/slipper ball joints 22 instead of behind the swashplate 30. As a result, the ball pivot axis 44 is either in the same plane or close to the same plane as the ball joint plane 27. By having the ball pivot axis 44 and ball joint plane 27 either co-planar or nearly co-planar the variability of the swashplate moments is minimized. This not only reduces the axial length of the axial hydraulic machine 10 the design additionally allows for better control of the swashplate 30. Thus, at the very least all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. An axial hydraulic machine comprising:

a housing;

a cylinder block disposed within the housing and having a plurality of reciprocating pistons disposed therein;

a swashplate having a first end rotatably connected to the plurality of reciprocating pistons;

a shaft disposed through the swashplate and cylinder block within the housing to rotate the cylinder block;

a first support ball having a first center point and received by a second end of the swashplate;

a second support ball having a second center point and received by the second end of the swashplate;

a support pivot axis extending from the first center point to the second center point;

wherein the support pivot axis intersects at least one of the plurality of reciprocating pistons; and wherein the plurality of reciprocating pistons comprise a plurality of piston bodies and slippers and wherein the support pivot axis intersects the at least one reciprocating piston at a slipper.

2. An axial hydraulic machine comprising:

a housing;

a cylinder block disposed within the housing and having a plurality of reciprocating pistons disposed therein;

a swashplate having a first end rotatably connected to the plurality of reciprocating pistons;

a shaft disposed through the swashplate and cylinder block within the housing to rotate the cylinder block;

a first support ball having a first center point and received by a second end of the swashplate;

a second support ball having a second center point and received by the second end of the swashplate;

a support pivot axis extending from the first center point to the second center point;

wherein the support pivot axis intersects at least one of the plurality of reciprocating pistons; and wherein the plurality of reciprocating pistons have a joint plane adjacent the swashplate and wherein the support pivot axis and joint plane are in the same plane.

3. The machine of claim 2 wherein the support pivot axis intersects at least a portion of the swashplate.

4. The machine of claim 2 wherein the shaft rotates the cylinder block about an axis of rotation of the shaft, each of the plurality of pistons has a piston axis parallel to the axis of rotation of the shaft a first radial distance from the axis of rotation of the shaft, and a second radial distance is defined from the axis of rotation of the shaft to the first center point wherein the second radial distance is greater than the first radial distance.

* * * * *